US011460172B2

(12) United States Patent
Ameloot et al.

(10) Patent No.: US 11,460,172 B2
(45) Date of Patent: Oct. 4, 2022

(54) METAL FLUSH-MOUNTED BOX FOR INSTALLING A LIGHT FITTING, KIT AND USING THE KIT

(71) Applicant: Delta Light NV, Wevelgem (BE)

(72) Inventors: Peter Ameloot, Wevelgem (BE); Koen Dequae, Wevelgem (BE); Stefaan Gaeremynck, Wevelgem (BE)

(73) Assignee: Delta Light NV, Wevelgem (BE)

( * ) Notice: Subject to any disclaimer, the term of this patent is extended or adjusted under 35 U.S.C. 154(b) by 0 days.

(21) Appl. No.: 17/212,136

(22) Filed: Mar. 25, 2021

(65) Prior Publication Data

US 2022/0205616 A1 Jun. 30, 2022

(30) Foreign Application Priority Data

Dec. 30, 2020 (BE) ..... 2020/5998

(51) Int. Cl.

| | |
|---|---|
| ***F21V 15/01*** | (2006.01) |
| ***F21V 21/22*** | (2006.01) |
| ***F21V 31/00*** | (2006.01) |
| ***F21S 8/04*** | (2006.01) |

(52) U.S. Cl.

CPC ..... *F21V 15/01* (2013.01); *F21V 21/22* (2013.01); *F21S 8/043* (2013.01); *F21V 31/005* (2013.01)

(58) Field of Classification Search

CPC ..... F21V 15/01; F21V 21/04; F21V 21/03; F21V 21/025; F21S 8/02; F21S 8/026; F21S 8/04; F21S 8/043

See application file for complete search history.

(56) References Cited

U.S. PATENT DOCUMENTS

| | | | | |
|---|---|---|---|---|
| 3,815,857 A * | 6/1974 | McFarlin | F21V 17/166 | 248/222.14 |
| 5,093,769 A * | 3/1992 | Luntsford | F21V 7/28 | 362/269 |
| 5,580,158 A * | 12/1996 | Aubrey | F21S 8/026 | 362/640 |
| 5,746,507 A * | 5/1998 | Lee | F21V 21/04 | 362/147 |
| 6,036,337 A * | 3/2000 | Belter | F21S 8/02 | 362/257 |

(Continued)

FOREIGN PATENT DOCUMENTS

WO 2008150288 A1 12/2008

*Primary Examiner* — Jong-Suk (James) Lee
*Assistant Examiner* — James M Endo
(74) *Attorney, Agent, or Firm* — Vorys, Sater, Seymour and Pease LLP

(57) ABSTRACT

A flush-mounted box for installation of a light fitting includes a metal housing that includes a plurality of side walls, at least one side wall defining an opening configured to mount a junction box and/or a cable entry, a bottom wall mountable to the plurality of side walls and defining at least one cutout configured to receive a light fitting, and a top wall mounted to the plurality of side walls opposite the bottom wall. The box further includes a rail rotatably attached to the top wall, wherein the rail is longitudinal and one end of the rail is positioned above the at least one recess, and a mounting bracket configured for sliding attachment according to a longitudinal direction of the mounting bracket in the rail.

14 Claims, 5 Drawing Sheets

(56) References Cited

U.S. PATENT DOCUMENTS 6,079,851 A * 6/2000 Altman ..... F21S 8/02 362/217.05
6,123,438 A * 9/2000 Hentz ..... F21S 8/02 362/148
6,176,599 B1 * 1/2001 Farzen ..... F21S 8/026 362/145
6,402,350 B1 * 6/2002 Ward ..... F21S 8/02 174/50
7,438,433 B1 * 10/2008 Steadman ..... F21S 8/02 362/147
9,726,354 B1 * 8/2017 Delano ..... F21V 21/14
10,066,797 B1 * 9/2018 Tan ..... F21V 14/04
10,174,891 B1 1/2019 Zheng et al.
2003/0161155 A1 * 8/2003 Caluori ..... F21V 23/026 362/365
2004/0090772 A1 * 5/2004 Newbold ..... F21S 8/026 362/147
2005/0254263 A1 11/2005 Harwood
2006/0261235 A1 * 11/2006 Rippel ..... F21V 21/04 248/343
2008/0002414 A1 * 1/2008 Miletich ..... F21V 19/04 362/382
2008/0165545 A1 * 7/2008 O'Brien ..... F21V 29/15 362/364
2008/0304269 A1 * 12/2008 Pickard ..... F21V 21/048 362/365
2009/0135608 A1 * 5/2009 Sell ..... F21V 19/0055 362/365
2009/0231862 A1 * 9/2009 Seo ..... F21V 17/02 362/365
2009/0244888 A1 * 10/2009 Caluori ..... F21S 8/02 362/147
2009/0268435 A1 * 10/2009 Mandy ..... F21V 19/04 362/147
2010/0165607 A1 * 7/2010 Russo ..... F21S 8/02 362/147
2010/0165643 A1 * 7/2010 Russo ..... F21V 21/04 362/365
2010/0165646 A1 * 7/2010 Russo ..... F21S 8/02 362/430
2010/0224404 A1 * 9/2010 Rippel ..... H02G 3/20 174/520
2010/0246172 A1 * 9/2010 Liu ..... F21V 15/01 362/235
2010/0277905 A1 * 11/2010 Janik ..... F21V 29/763 362/235
2010/0294560 A1 * 11/2010 Dahl ..... F21V 15/01 174/520
2011/0013405 A1 1/2011 Buse
2011/0176295 A1 * 7/2011 Chang ..... F21V 21/04 362/147
2011/0188254 A1 * 8/2011 Burt ..... F21V 15/01 362/365
2011/0226919 A1 * 9/2011 Fryzek ..... F21S 8/026 248/298.1
2012/0044703 A1 * 2/2012 Wilson ..... F21V 21/048 362/365
2012/0044704 A1 * 2/2012 Wilson ..... F21S 8/026 362/365
2012/0267139 A1 * 10/2012 Sartini ..... H02G 3/20 174/61
2012/0327638 A1 * 12/2012 Tajima ..... F21V 23/026 362/147
2013/0320165 A1 * 12/2013 Kerr, Jr. ..... F21V 21/04 248/213.2
2014/0029271 A1 * 1/2014 Esmailzadeh ..... F21S 8/026 362/365
2014/0301092 A1 * 10/2014 Wronski ..... F21V 19/00 362/418
2015/0078012 A1 * 3/2015 Delano ..... F21S 8/02 362/365
2015/0153007 A1 * 6/2015 Chen ..... F21V 19/0025 362/217.1
2015/0219325 A1 * 8/2015 Clark ..... F21V 7/041 362/294
2015/0252988 A1 * 9/2015 Rashidi Doust ..... F21S 8/026 362/285
2015/0300612 A1 * 10/2015 Stathes ..... F21S 8/026 362/419
2016/0040839 A1 * 2/2016 Driscoll ..... F21V 29/767 362/294
2016/0201884 A1 * 7/2016 Ramirez ..... F21V 23/006 362/147
2016/0201887 A1 * 7/2016 Ilenbiluan ..... F21V 17/002 362/382
2016/0209007 A1 * 7/2016 Belmonte ..... F21V 21/048
2017/0045209 A1 * 2/2017 Schubert ..... F21V 21/14
2017/0059135 A1 * 3/2017 Jones ..... F21V 17/002
2017/0219190 A1 * 8/2017 Wronski ..... F21V 21/04
2017/0307188 A1 * 10/2017 Oudina ..... F21V 21/04
2018/0031212 A1 * 2/2018 Nguyen ..... F21S 8/026
2018/0119907 A1 * 5/2018 O'Brien ..... F21S 8/026
2018/0202634 A1 * 7/2018 Farzan ..... F21V 23/009
2018/0323592 A1 * 11/2018 Wronski ..... F21V 21/043
2019/0044313 A1 * 2/2019 Momin ..... F21V 21/03
2019/0104585 A1 * 4/2019 Albrechtsen ..... F21V 23/023
2020/0260541 A1 * 8/2020 Major ..... F21V 23/006
2020/0300428 A1 * 9/2020 Momin ..... F21V 21/04
2020/3000428 9/2020 Momin et al.

* cited by examiner

METAL FLUSH-MOUNTED BOX FOR INSTALLING A LIGHT FITTING, KIT AND USING THE KIT

TECHNICAL FIELD

The invention relates to a flush-mounted box for installing a light fitting.

In a second aspect, the invention also relates to a kit for forming a flush-mounted box for installation of a light fitting.

In a third aspect, the invention also relates to a use of a kit according to the second aspect to form a flush-mounted box according to the first aspect.

BACKGROUND

In the United States it is standard, for fire safety reasons, to provide a metal housing, built into the ceiling, when installing a light fitting, for example in a ceiling, with the metal housing having junction boxes for wiring and other electronic components. Standard housing designs and junction boxes usually have very limited access to the housing after installation, making wiring changes after the recessed luminaire has been installed in the ceiling very difficult.

Furthermore, in the United States, UL1598 and NFPA 70/National Electrical Code standards require that connections of wiring, such as the connection of a light fitting or the controller of a light fitting to a mains power supply, can be inspected visually through the light fitting opening in the housing after removal of the light fitting. This means that this opening must be large enough to facilitate such an inspection. In some cases, visual inspection or repair requires opening or even removing a junction box on the outside of the housing through the opening, which again creates difficulties.

U.S. Pat. No. 7,658,517 describes such a metal housing for a light fitting for installation in, for example, a ceiling. A metal housing according to US '517 comprises a junction box on a side wall on the outside, where the junction box comprises a hinged door which can be opened into the metal housing and above the opening for the light fitting. This facilitates visual inspection of connections and makes it easier to carry out repairs.

This well-known metal housing has the following disadvantage or problem. A transformer or a controller for a light fitting is fitted in the junction box. Once the junction box has been turned up to above the opening for the light fitting, the junction box still obstructs the view on the transformer or the controller of the light fitting. This makes a visual inspection of the transformer or controller itself difficult, let alone any repairs, where the transformer or controller still has to be replaced more or less blindly. If a wiring connection is located close to the transformer or controller, a visual inspection or repair of the connection may still be hampered by the open junction box.

The present invention aims to solve at least some of the above-mentioned problems or disadvantages.

SUMMARY OF THE INVENTION

In a first aspect, the present invention relates to a flush-mounted box according to claim 1.

The main advantage of a flush-mounted box according to claim 1 is that the flush-mounted box comprises a rail and a mounting bracket, wherein the rail is longitudinal, wherein one end of the rail is positioned above a cutout configured to receive a light fitting, and wherein the mounting bracket is configured to slide in accordance with the longitudinal direction of the mounting bracket in the rail. The rail and the mounting bracket make it possible to make connections between, for example, a mains power supply and a controller for a light fitting outside the flush-mounted box. The controller is attached to the mounting bracket. After making the connections, the mounting bracket with the controller is slid into the rail through the cut-out in the flush-mounted box. The controller is then attached to the rail and the controller and the connections are in the flush-mounted box. The controller and connections can be easily removed from the flush-mounted box by sliding the mounting bracket out of the rail through the cutout. This is particularly advantageous for easy visual inspection or repair of the connections and the controller, while a flush-mounted box according to the present invention complies with UL1598, Edition 4, and NFPA 70/National Electrical Code, Edition 2020.

Preferred embodiments are shown in conclusions 2 to 11.

A specific preferred embodiment is a flush-mounted box according to claim 2.

With this preferred embodiment, the rail can be rotated in a plane parallel to the bottom wall of the flush-mounted box. This is particularly advantageous, since the rail can be swivelled away from the luminaire cut-out after the mounting bracket has been glided on. This provides maximum free space above the cut-out for receiving a light fitting, allowing a light fitting with a greater installation height to be installed in a flush-mounted box according to the present invention.

In a second aspect, the present invention relates to a kit according to claim 12.

The kit is advantageous for forming a flush-mounted box with similar advantages as a flush-mounted box according to the first aspect from a limited number of components. Due to the fact that the kit comprises two flat metal plates to form a metal body for the flush-mounted box, the kit takes up less volume than an assembled flush-mounted box. This is particularly advantageous for transport, as more wall boxes can be transported in the same volume and transport costs can be reduced.

Preferred embodiments of the kit are described in follow-up conclusions 13 to 14.

In a third aspect, the present invention relates to a use according to claim 15. This use results in an advantageous formation of a flush-mounted box in which connections can easily be visually inspected and repaired and in which the flush-mounted box can be transported with a limited volume to, for example, a construction site.

DETAILED DESCRIPTION

Figure 1:
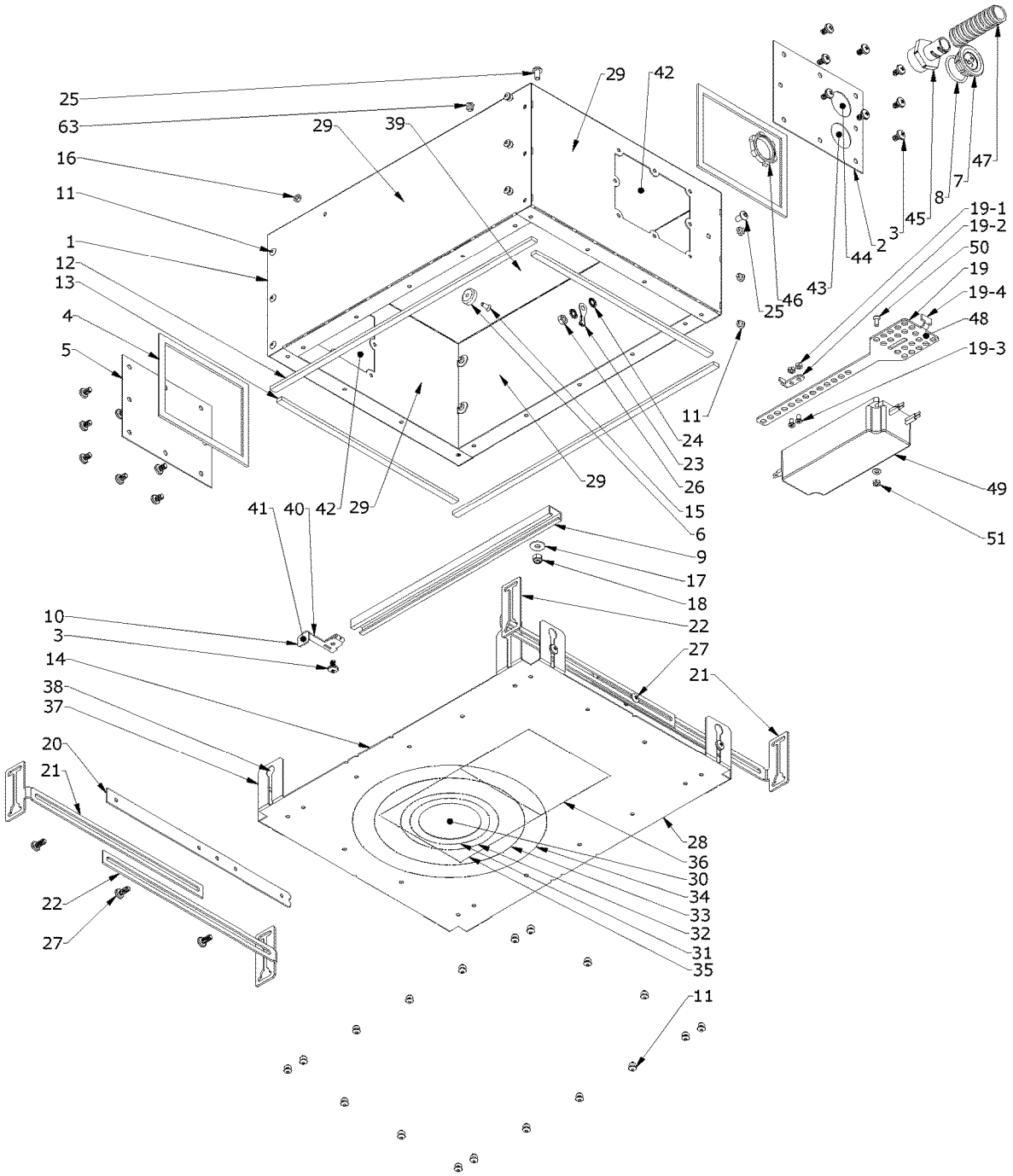
FIG. 1 shows an exploded view of a flush-mounted box according to an embodiment of the present invention.

Unless otherwise defined, all terms used in the description of the invention, including technical and scientific terms, have the meaning generally understood by those skilled in the technical field of the invention. For a better assessment of the description of the invention, the following terms are explained explicitly.

In this document, "a", "the" and "it" refer to both the singular and the plural unless the context clearly indicates otherwise. For example, "a segment" means one or more than one segment.

The terms "comprise", "comprising", "consist", "consisting of", "providing", "include", "including" are synonyms and are inclusive or open terms indicating the presence of what follows, which do not exclude or prevent the presence of other components, characteristics, elements, members, steps, known from or described in the state of the art.

The quoting of numerical intervals through the endpoints includes all integers, fractions and/or real numbers between the endpoints, these endpoints included.

In a first aspect, the invention relates to a flush-mounted box for installation of a light fitting.

According to a preferred embodiment, the flush-mounted box comprises a metal housing. The metal housing comprises a bottom wall, side walls and a top wall. The bottom wall is a wall of the metal housing that faces towards the room after installation of the flush-mounted box in a ceiling of a room. In this case, the bottom wall of the metal housing is effectively at the bottom and the top wall is effectively at the top of the metal housing. It is clear to a professional in the technical field that after installation of the flush-mounted box in a wall or a floor in a room, the bottom wall also faces towards the room and in this case is not located at the bottom of the metal housing.

The bottom wall comprises at least one cut-out. The cut-out is configured to receive a light fixture. The cutout is circular, rectangular, square or of any other suitable shape. The cutout is larger than a cross-section of the light fixture and is smaller than a supporting surface of the light fixture. The supporting surface is the surface of the light fitting with which the light fitting rests against the lower wall of the metal housing outside or inside the flush-mounting box.

At least one sidewall of the metal enclosure comprises an opening configured for mounting a junction box and/or a cable entry.

The junction box is a metal box. The junction box is attached to at least one side wall in a removable manner. The junction box completely covers the opening in the side wall. At least one wall of the junction box is a cable entry positioned at the height of the opening in the at least one side wall of the metal housing. The cable entry comprises at least one metal tube right through the junction box wall, suitable for passing an electric cable or wires through the junction box. Alternatively the cable entry comprises at least one cable gland or at least one other suitable passage for the passage of an electric cable or electric wires through the junction box. Alternatively the junction box is substantially open at the height of the opening in at least one sidewall of the metal housing. Optionally, the junction box comprises a removable cover which is positioned over the opening in at least one sidewall of the metal enclosure. This is advantageous because the cover of the junction box can be opened from inside the flush-mounted box for visual inspection or repairs of connections or control of a light fitting in the junction box.

The cable entry is a metal plate, comprising at least one metal tube or at least one cable gland or at least one other suitable entry passing through the metal plate, suitable for passing an electric cable or electric wires through the metal plate. The cable entry is detachably mounted on at least one side wall. The cable entry completely covers the opening in at least one side panel.

The enclosure comprises a rail and a mounting bracket. The rail is longitudinal. The rail is mounted in a plane parallel to the bottom wall. One end of the rail is positioned above the at least one cut-out in the bottom wall. The end of the rail is an end according to the longitudinal direction. The mounting bracket is configured for sliding attachment according to the longitudinal direction of the mounting bracket in the rail. By positioning an end of the rail above the at least one cutout, it is possible to slide the mounting bracket through the at least one cutout in the rail and attach it to the rail.

The rail and the mounting bracket are particularly advantageous for making connections between, for example, a mains supply and a controller of a light fitting outside the flush-mounted box, or for making a direct connection of a light fitting to a mains power supply. This is much easier than making connections inside the flush-mounted box through the at least one cut-out. This is also advantageous because it allows cut-outs smaller than a human hand. Consequently, smaller luminaires can be used than with a flush-mounted boxes according to the state of the art. The controller of the luminaire is attached to the mounting bracket. If necessary, wiring connections can also be attached to the mounting bracket. This is particularly advantageous if a light is connected directly to the mains power supply. After the connections have been made, the mounting bracket with the controller, or in the case of a luminaire connected directly to the mains power supply, a mounting bracket with attached wiring connections, is slid through the cutout in the metal housing at the aforementioned end above the at least one cutout in the rail, after which the controller is fixed to the rail and the controller and the connections are in the flush-mounted box. The controller and the connections can be removed from the flush-mounted box simply by sliding the mounting bracket out of the rail through the at least one cutout. This is particularly advantageous for simple visual inspection or for repairing the connections. The fact that the controller is mounted on the mounting bracket also makes it easier to visually inspect the controller of the luminaire. Visual inspection or repair of a connection or control is not hindered by the rail or mounting bracket.

By mounting a junction box and/or a cable entry on the said opening and by mounting a light fitting in the at least one cut-out, the metal housing becomes a completely sealed metal flush-mounted box. This is particularly advantageous in order to limit the spread of a possible fire to connections and/or the controller of the light fitting and/or the light fitting itself inside the flush-mounted box.

A flush-mounted box according to the present invention impedes the spread of a possible fire in the flush-mounted box and allows visual inspection of connections, so that a flush-mounted box complies with UL1598, Edition 4, and NFPA 70/National Electrical Code, Edition 2020.

It is clear to a skilled person in the technical field that the controller of a luminaire is not limited to an electronic controller, but may also comprise a power supply, a transformer or any other suitable component.

It is also clear to a skilled person in the technical field that the flush-mounting box is not only suitable for installing a light fitting but also for installing other electrical or electronic devices. Non-limited examples of such devices are smoke detectors, movement detectors, loudspeakers, . . . . It is clear that in this case the mounting bracket can be used for fixing a component belonging to the electrical or electronic device.

In an embodiment, the at least one cut-out is circular with a diameter of at least 50 mm and at most 80 mm. Such a cut-out is advantageous for mounting a small light fitting with a circular cross-section and a support surface larger than the cut-out.

In an embodiment, the rail is attached to the top wall at a distance of no more than 4 cm, preferably no more than 3 cm, more preferably no more than 2 cm, even more preferably no more than 1 cm and even more preferably no more than 0.5 cm. This is advantageous for a spacious free space above the cutout for receiving a light fixture. Preferably, the rail is mounted against the top wall. This is advantageous because it prevents the rail from being pulled down when the mounting bracket is fixed in the rail.

In an embodiment, the metal housing comprises an opening in at least two opposite side walls, configured for attachment of a junction box or a cable entry. The opening, the junction box and the cable entry are similar to the opening, the junction box and the cable entry as in a previously described embodiment. Two opposite openings are advantageous for passing through wiring from a first side of the flush-mounted box to a second opposite side, where a light fitting is connected to the wiring in the flush-mounted box. This is the case, for example, when looping an electric cable from a light fitting in a first flush-mounting box to a light fitting in a second flush-mounting box. Two opposing openings are also advantageous when wiring is fed through on the first side of the flush-mounting box and when, for example, a light fitting controller or additional electronic components are connected in a junction box on the second side of the flush-mounting box. This is the case, for example, if the controller for the light fitting is too large to be fixed to the mounting bracket or if, for example, a component of a home automation system is to be installed in the flush-mounting box as an additional electronic component alongside the controller for the light fitting.

According to a preferred embodiment, the rail is rotatable in a plane parallel to the bottom wall. Preferably, the rail is rotatable around a second end of the rail. The second end of the rail is according to the longitudinal direction. The second end of the rail is opposite to the end of the rail positioned above the at least one cutout. Preferably, the second end of the rail is rotatably attached to an axis on the top wall.

This is particularly advantageous since the rail can be swivelled away from above the cut-out for the light fitting after the mounting bracket has been glided on. This provides maximum free space above the cut-out for receiving a light fitting, allowing a light fitting with a greater recessed height to be installed in a flush-mounted box according to the present invention.

In a further embodiment, a sidewall comprises a locking mechanism configured to detachably hold the rail against the sidewall. A locking mechanism is advantageous for holding a rotatable rail against a side wall after a mounting bracket is glidingly attached to the rail and the rotatable rail is turned away from above the at least one recess. This prevents the rotatable rail from swinging back to a position above the minimum cutout, for example, due to a pulling force on wires, before the luminaire is mounted. The locking mechanism makes it easier to install a light fitting.

According to an embodiment, the locking mechanism is a spring-loaded hook or pin. The hook or pin is configured to engage in an eye. The hook or pin is attached to the sidewall and the eye is attached to the rotatable rail. Alternatively, the hook or pin is attached to the rotatable rail and the eye is attached to the sidewall. By rotating the rail towards the side wall the hook or pin moves against the spring force and opens the locking mechanism, after which the spring force engages the spring or pin in the eye and the locking mechanism is closed. The closing mechanism can be opened again by moving the hook or pin opposite to the spring force.

In an alternative embodiment, the closing mechanism comprises a first part of a hook-and-loop fastener on the rail and a second complementary part of the hook-and-loop fastener on the sidewall. By pressing the rail against the sidewall, hooks and loops of both parts of the hook and loop fastener interlock and the closing mechanism is closed. The hook and loop fasteners require minimal force to release. The closing mechanism can be reopened by rotating the rail away from the side wall with a force greater than the minimum force stated. This embodiment is advantageous over a previously described embodiment with a spring-loaded hook or pin in that no direct access to the locking mechanism is required to open the locking mechanism.

In a preferred embodiment, the locking mechanism comprises a magnet. The magnet is attached to a side wall. The rotatable rail is at least partially ferromagnetic. By pressing the rail against the side wall, the at least partially ferromagnetic portion of the rail is attracted to the magnet. The closing mechanism is closed. The magnet has a pulling force. The closing mechanism can be opened again by rotating the rail away from the side wall with a force greater than the said pulling force. This embodiment has similar advantages to a previously described embodiment involving a hook-and-loop fastener. An additional advantage is that a magnet needs to be positioned less accurately in relation to the rotatable rail than the two complementary parts of a hook-and-loop fastener.

In a preferred embodiment, the mounting bracket comprises a hook element. The rail comprises a longitudinal slot, wherein the slot is configured to receive hook elements. A hook element is movable by sliding in the longitudinal direction of the rail through the slot. The rail comprises an opening at the end that is positioned above the at least one cutout. Said opening is configured to receive a hook element in the slot. This is advantageous for slidingly fixing the mounting bracket in the slot at said end. Preferably, the rail at the second opposite end is closed or the rail at said second end comprises a stop in the slot. This is advantageous to prevent a hook element at the second opposite end from sliding out of the slot of the rail.

In a previously described embodiment where the rail is rotatable, the axis around which the rail rotates is preferably the stop at the second opposite end. This is advantageous because it saves material and manufacturing steps.

Preferably, the slot has a C-shaped cross-section and a hook element is a T-shaped protrusion, wherein a standing leg of the T-shaped protrusion is attached to the mounting bracket, wherein a lying leg of the T-shaped protrusion is configured to be inserted into the C-shaped cross-section of the slot and wherein the standing leg of the T-shaped protrusion protrudes through the C-shaped cross-section. The lying leg of the T-shaped protrusion prevents a hook element from being removed from the slot.

In a preferred embodiment, the rail comprises a detachable stop at the end of the rail positioned above the at least one cutout, configured for stopping a sliding movement of a hook element from the rail at said end. A detachable stop is advantageous to prevent a mounting bracket, after sliding attachment to the rail, from sliding out of the rail at said end, while by detaching the stop it is possible to attach or remove the mounting bracket slidingly to or from the rail, for example for visual inspection or repair.

In a further embodiment, the detachable stop comprises a protrusion, wherein the protrusion extends perpendicular to the rail and parallel to the top wall, and wherein the protrusion comprises a ferromagnetic surface at a free end. The ferromagnetic surface is oriented substantially perpendicular to the protrusion.

This design is particularly advantageous in combination with previously described embodiments, in which a rail is rotatable and in which a locking mechanism comprises a magnet. The ferromagnetic surface is suitable for attraction against the magnet. A ferromagnetic surface on a protrusion perpendicular to the rail and parallel to the side wall to which the magnet is attached is advantageous to prevent a rotatable rail, due to dimensions of the mounting bracket and/or a controller of a light fixture, from being rotated against a side wall, thus preventing the rail from being attracted by the magnet. A detachable stop, comprising a protrusion and a ferromagnetic surface, is advantageous because it saves material and manufacturing steps for the manufacture of a separate protrusion and ferromagnetic surface. A further advantage is that the protrusion and the ferromagnetic surface do not interfere with the fixing process when the mounting bracket is slid into the rail.

In a preferred embodiment, a mounting bracket extends flat along a longitudinal direction, whereby the mounting bracket comprises two hook elements, distributed in the longitudinal direction of the mounting bracket and transverse to the plane of the mounting bracket. This is advantageous because it ensures that a mounting bracket is fixed substantially parallel to the top wall, which means that the mounting bracket and a controller for a light fitting attached to it are positioned as close to the top wall as possible, which is advantageous in terms of ample free space above the cut-out for receiving a light fitting.

This embodiment is also advantageous in combination with the previously described designs in which the rail can be rotated. This embodiment prevents a mounting bracket and a luminaire controller attached to it from dragging on the bottom wall of the housing during rotation, which could damage the controller and the wiring connection.

An additional advantage of this design is that it prevents a mounting bracket and the controller of a luminaire attached to it from sagging, which would result in a continuous pulling force on the wiring that could lead to breakage.

In a further embodiment, a first hook element is positioned at a first end in the longitudinal direction of the mounting bracket and a second hook element is movable in the longitudinal direction of the mounting bracket. The second hook element is loosely attached to the mounting bracket and can be fixed to the mounting bracket at several positions along the longitudinal direction. Preferably, the second hook element is fastened by means of bolts or screws and nuts. Alternatively, the second hook element is fastened to the mounting bracket in a sliding longitudinal direction and the second hook element can be clamped in several positions. This is advantageous because the second hook element can be positioned right next to a controller, with the controller being positioned between the first and second hook elements, so that when the mounting bracket is fixed to the rail in a sliding direction, part of the mounting bracket extends beyond the controller of a luminaire. This part can serve as a handle for an installer when sliding the mounting bracket in the rail.

In a preferred embodiment, the mounting bracket comprises multiple mounting openings configured for mounting a control of a light fixture. Preferably, the mounting bracket comprises a flat and rectangular portion. The flat and rectangular portion preferably comprises a grid pattern of mounting openings. The mounting openings comprise circular holes and at least one elongated groove. The flat and rectangular section preferably has a grid pattern of circular holes. The circular holes have a diameter of at least 2 mm and at most 5 mm. The elongated groove preferably has a length of at least 5 mm and not more than 15 mm. The elongated groove preferably extends lengthwise. This embodiment is advantageous for attaching various types of controllers, so that no specific mounting bracket has to be provided for each type of controller.

According to a preferred embodiment, the flush-mounted box comprises at least one incision. The incision is a partial perimeter for an opening configured to receive a light fitting. An incision is through the base plate. The incision has a similar function to the at least one cutout, except that an cutout is a complete perimeter for an opening configured to receive a light fixture. As a result, a portion of the base plate is cut out to form the opening. At the incision, a portion of the base plate within the partial perimeter is still connected to a portion of the base plate outside the partial perimeter. The part of the base plate inside the partial circumference is connected on at least three points to the part of the base plate outside the partial circumference by a connecting strip. The connecting strip is thus an interruption of the partial circumference. A connecting strip interrupts the partial circumference over a length of at least 1.0 mm and at most 5.0 mm. This embodiment is advantageous because it makes a single flush-mounting box suitable for receiving various types of light fittings, where the various types have different cross-sections and/or support surfaces and where there is no cut-out in the bottom wall of the metal housing for each type of light fitting. By breaking the connecting strip, the partial circumference is a complete circumference and the part of the bottom plate within the partial circumference is cut out.

In a further embodiment, a connecting strip comprises a notch or a centering hole. The notch or the centering hole is advantageous for drilling a hole. By drilling a hole with a diameter equal to or greater than the length of the connecting strip comprising the notch or centering hole, the connecting strip is easily and quickly broken.

In a preferred embodiment, the at least one cutout is located within the partial circumference of the at least one incision. This is advantageous because it makes the flush-mounting box suitable for accommodating at least one type of light fitting in the cutout, whereby after adapting the metal housing of the flush-mounting box to a different type of light fitting by breaking through connecting strips, there is no additional cutout in the base plate. The cutout is only larger than the original cutout.

In a preferred embodiment, the flush-mounted box comprises two telescopic suspension brackets. The telescopic suspension brackets extend lengthwise. The telescopic suspension brackets extend in a longitudinal direction. The telescopic suspension brackets have two opposite ends in the longitudinal direction. The telescopic suspension brackets comprise a fixing plate at both ends. The fixing plate is oriented transversely to the longitudinal direction of the telescopic suspension bracket. The fixing plate comprises a hole and/or slit suitable for screwing the telescopic suspension brackets with a screw or bolt through the hole or slit to, for example, beams of a ceiling or floor or posts of a wall. The telescopic suspension brackets are attached to the metal housing on two opposite sides outside the metal housing. The telescopic suspension brackets are fixed to the metal housing between the bottom wall and the bottom wall. The telescopic suspension brackets are preferably parallel to a side wall and parallel to the bottom wall. Telescopic suspension brackets are advantageous for fixing the flush-mounted box between beams of a ceiling or floor, or between uprights of a wall, where the telescopic beams are fully or partially retracted or extended depending on a distance between the said beams or uprights.

In a further implementation form, the metal housing comprises at least two lips on at least two opposite sides of the bottom wall. The lips are outside the metal housing. The lips are folded towards the top wall. The lips are preferably substantially parallel to a side wall. Each lip comprises a hole or slit or keyhole slot. A keyhole slot is configured for detachable attachment of the metal housing to a telescopic suspension bracket.

Preferably, the metal housing is attached to the telescopic suspension brackets by bolts or screws through the keyhole slots. A hole or keyhole slot is advantageous for adjusting a position of the metal housing relative to the telescopic suspension brackets. This embodiment is advantageous for simple fixing of a flush-mounted box according to the present invention to, for example, beams in a ceiling or floor or to posts in a wall, whereby telescopic suspension brackets are first fixed to the beams or posts and then the metal housing is detachably fixed to the telescopic suspension brackets.

In a further embodiment, a telescopic mounting bracket comprises a mounting plate, wherein the mounting plate comprises, in at least two positions, a hole for screwing in a bolt or screw and wherein the positions of the at least two holes correspond to positions of the lips with keyhole slots on the bottom wall. The at least two holes comprise internal or external threads. The screws may or may not be sheet metal screws. This embodiment is advantageous for easy, detachable fastening of the metal housing to the telescopic beams, because bolts or screws are already present in the telescopic suspension brackets at the correct positions.

In a preferred embodiment, the metal housing is airtight on the side walls and the top wall. This is advantageous in order to avoid an air flow from the room in which the box is installed to an adjacent room through the box and for example the ceiling, floor or wall in which the box is installed.

In a second aspect, the invention relates to a kit for forming a flush-mounted box for installation of a light fitting.

According to a preferred embodiment, the kit comprises a first flat metal plate for forming a bottom wall and a second flat metal plate for forming side walls and a top wall.

The first metal plate comprises at least one cutout, configured to receive a light fitting. The cutout is circular, rectangular, square or of any other suitable shape. The cutout is larger than a cross-section of the light fixture and is smaller than a support surface of the light fixture.

The second metal plate comprises a rectangular base, suitable as an upper wall. Rectangular side panels, suitable as side walls, are adjacent to the sides of the rectangular base. A rectangular side plane extends over the full side of the rectangular base plane, to which the rectangular side plane is adjacent. One side of a rectangular side plane, transverse to the side of the rectangular base plane, to which the rectangular side plane is adjacent, has a length which is substantially the same for each rectangular side plane. The second metal sheet comprises a fold line between the rectangular base plane and each rectangular side plane. This is advantageous for folding a rectangular side surface substantially transverse to the base surface, to form a beam-shaped metal housing with an open wall, lying opposite the top wall. The first metal plate is configured to close off said open wall. Two opposite rectangular side surfaces comprises on sides, transverse to the side of the rectangular base surface, to which the rectangular side surface is adjacent, a folding piece. The second metal plate comprises a folding line between the rectangular side plane and the folding piece. The folding piece extends in the direction of the folding line partly or completely over the side of the rectangular side plane, to which the folding piece is adjacent. This is advantageous for folding a folding piece substantially perpendicular to the rectangular side plane. An folding piece is advantageous for connecting adjacent rectangular faces transversely. Adjacent rectangular faces are connected by screws or nuts and bolts through a first rectangular face and through a folding piece of a second adjacent rectangular face. The screws may or may not be sheet metal screws. Alternatively, rivets are used instead of bolts or screws and nuts. The rectangular side faces and/or the folding pieces may or may not comprise holes to receive bolts, screws or rivets. The holes may or may not comprise internal threads. Alternatively, a first rectangular side surface and a folding piece of a second adjacent rectangular side surface are glued together.

The second metal plate comprises in at least one part, suitable as a side wall, an opening configured for mounting a junction box or a cable entry. The junction box and the cable entry are as described in previous embodiments of the flush-mounted box. Preferably, the kit comprises one or more metal plates configured for detachably attaching to the at least one part of the second metal plate and for completely covering the opening in the at least one part of the second metal plate.

The kit comprises a rail and a mounting bracket, wherein the rail is longitudinally oriented, wherein the second plate comprises a mounting point configured for attachment of an end of the rail above the at least one cutout in the bottom wall, and wherein the mounting bracket is configured for sliding attachment according to the longitudinal orientation of the mounting bracket in the rail. By positioning an end of the rail above the at least one recess, it is possible to slide the mounting bracket through the at least one recess in the rail and attach it to the rail.

A kit according to the present invention is advantageous for forming a flush-mounted box, whereby the flush-mounted box impedes the spread of a possible fire in the flush-mounted box and whereby visual inspection of connections is possible, so that a flush-mounted box formed with the kit complies with the standards UL1598, Edition 4, and NFPA 70/National Electrical Code, Edition 2020.

Because the kit comprises two flat metal plates to form a metal housing for the flush-mounted box, the kit takes up less volume than an assembled flush-mounted box. This is particularly advantageous for transport, allowing more wall boxes to be transported in the same volume, thus reducing transport costs.

In a further embodiment, at least two opposite rectangular side planes on a side, opposite to the side bordering the rectangular base plane, comprise a lip. Between a lip and a rectangular side plane adjacent to the lip is a folding line. A folding line is advantageous for the substantial transverse folding of the lip on the rectangular side surface that is adjacent to the lip. In the direction of the folding line, the lip extends wholly or partially over the side of the rectangular lateral plane with which it is adjacent. After transverse tucking of all lips on the rectangular side surface to which a lip is adjacent and transverse tucking of all rectangular side surfaces on the base surface, the lips lie in a plane parallel to the open wall. This is advantageous because a flat edge is formed around the open wall in this way, which is suitable for the application of a self-adhesive and airtight sealing tape and/or an airtight composition and/or an airtight seal for airtight finishing of a gap around the open wall between the first metal plate and the second metal plate. This is additionally advantageous for fixing the first metal plate to the open wall on the second metal plate. Optionally, the lips are provided with holes and/or slots for receiving rivets or screws or bolts for fastening the first metal plate to the second metal plate.

In an alternative embodiment, the first metal sheet comprises a rectangular base plane, whereby rectangular side planes are adjacent to at least two sides of the rectangular base plane of the first metal sheet. Between the rectangular base surface of the first metal sheet and an adjacent rectangular side surface, there may or may not be a fold line. A folding line is advantageous for manually folding a rectangular side plane perpendicular to the rectangular base plane. Without a folding line, a rectangular side plane is folded transversely on the rectangular base plane by machine. Preferably, a rectangular side plane is provided with holes and/or slots corresponding to holes and/or slots in rectangular side planes of the second metal sheet.

In a preferred embodiment, the kit comprises telescopic suspension brackets.

The telescopic suspension brackets extend lengthwise. The telescopic suspension brackets extend in a longitudinal direction. The telescopic suspension brackets have two opposite ends in the longitudinal direction. The telescopic suspension brackets comprise a fixing plate at both ends. The fixing plate is oriented transversely to the longitudinal direction of the telescopic suspension bracket. The fixing plate comprises a hole and/or slot suitable for screwing the telescopic suspension brackets with a screw or bolt through the hole or slot to, for example, beams of a ceiling or floor or posts of a wall. The telescopic suspension brackets are configured for attachment on two opposite sides outside the beam-shaped metal housing to the beam-shaped metal housing. The telescopic suspension brackets are fixed between the top wall and the bottom wall on the beam-shaped metal housing. The telescopic suspension brackets are preferably parallel to a side wall and parallel to the bottom wall. Telescopic suspension brackets are advantageous for fixing the formed box between beams of a ceiling or floor or between uprights of a wall, whereby the telescopic beams are fully or partially retracted or extended depending on a distance between the said beams or uprights.

In a preferred embodiment, the kit comprises a self-adhesive and airtight sealing tape and/or an airtight composition and/or an airtight seal, suitable for airtight finishing of gaps between side walls, bottom wall and top wall. Gaps between a sidewall and a junction box and/or cable entry and/or a metal plate for closing off an opening in a sidewall are preferably also made airtight. The airtight composition is preferably an airtight silicone.

This is advantageous in order to avoid an air flow from the room in which the box formed with the kit is installed to an adjacent room via the said box and, for example, the ceiling, floor or wall in which the said box is installed.

In a further aspect, the invention relates to a use of a kit according to the second aspect to form a flush-mounted box according to the first aspect.

The result is a cost-effective modular system in which connections and/or a light fitting controller can be easily inspected and repaired visually, the modular system complies with UL1598, Edition 4, and NFPA 70/National Electrical Code, Edition 2020, and can be transported to a construction site with limited volume, for example.

A person skilled in the technical field will appreciate that a kit according to the second aspect is preferably configured to form a flush-mounted box according to the first aspect, and that consequently a flush-mounted box according to the first aspect can be formed using a kit of the second aspect. Any feature described in this document, above and below, may therefore relate to any of the three aspects of the present invention.

In what follows, the invention is described by means of non-limiting figures illustrating the invention, which are not intended or should be interpreted as limiting the scope of the invention.

FIGURE DESCRIPTION

FIG. 1 shows an exploded view of a flush-mounted box according to an embodiment of the present invention.

The flush-mounted box comprises a first part (14) and a second part (1) of a metal housing.

The first part (14) of the metal housing is formed of a folded first metal plate and comprises a bottom wall (28). The bottom wall (28) is attached to four side walls (29) by means of rivets (11). Self-adhesive and airtight sealing tapes (12) and (13) are fitted between the bottom wall (28) and the four side walls (29). The bottom wall (28) comprises one cutout (30) configured to receive a light fixture. The bottom wall (28) comprises six incisions (31), (32), (33), (34), (35) and (36). The six incisions (31), (32), (33), (34), (35) and (36) are a partial perimeter of an opening configured to receive a light fixture. The six cutouts (31), (32), (33), (34), (35) and (36) are four concentric circular cutouts (31), (32), (33) and (34), wherein the cutout (30) lies within the four concentric circular cutouts (31), (32), (33) and (34), one square cutout (35), where the incision (30) lies within the square incision (35), and one rectangular incision (36), where the rectangular incision (36) is larger than the square incision (35) and partly coincides with the square incision (35) and where the incision (30) lies within the rectangular incision (36). The lower wall (28) comprises two lips (37) on each side, each lip (37) enclosing a keyhole slot (38). The lips (37) are folded towards a top wall (39). On two opposite sides of the metal housing, telescopic suspension brackets comprising a first movable part (21), a second movable part (22) and a mounting plate (20) are attached by means of screws (27) in the mounting plate (20) through the keyhole slots (38) to lips (37) of the lower wall (28).

The second part (1) of the metal housing is formed from a folded second metal plate and comprises the top wall (39) and the four side walls (29). The four side walls (29) are attached to each other by means of rivets (11). Gaps between the sidewalls (29) and between the sidewalls (29) and the upper wall (39) are made airtight by using self-adhesive and airtight sealing tapes or an airtight composition, such as silicone. These self-adhesive and airtight sealing tapes or airtight composition are not visible on the FIG. 1. A rail (9) is rotatably attached to the top wall (39). A first end of the rail (9) is positioned above the cut-out (30). The rail (9) is fixed to the upper wall (39) at an opposite second end by means of a screw (25), a washer (17) and a nut (18). The rail (9) is rotatable around the screw (25). The rail (9) comprises a detachable stop (10) which is fixed to the first end in the rail (9) by means of a screw (3). The detachable stop (10) comprises a protrusion (40), wherein the protrusion (40) extends transversely to the rail (9) and parallel to the top wall (39), and wherein the protrusion (40) comprises at a free end a ferromagnetic surface (41). The ferromagnetic plane (41) is oriented substantially perpendicular to the protrusion (40). The ferromagnetic plane (41) is capable of being attracted to a magnet (6). The magnet (6) is part of a locking mechanism. The magnet (6) is fixed to a sidewall (29) of the metal housing by means of a screw (15) and a nut (16). An earthing terminal (23) is attached to a side wall (29) of the flush-mounted box by means of a nut (26), two toothed rings (24) and a screw (25). The flush-mounted box comprises in two opposite side walls (29) an opening (42) configured for attachment of a junction box or cable entry (2). In this particular case, no junction box or cable entry (2) is attached to one opening (42), but the opening (42) is closed off with a metal plate (5). FIG. 1 does not show an example of a junction box. The cable entry (2) and the metal plate (5) are attached to the side walls (29) with screws (3). An airtight seal (4) is placed between the cable entry (2) and the side panel (29) and between the metal plate (5) and the side panel (29). A cable entry (2) in the embodiment shown in FIG. 1 comprises two holes (43) and (44). A first hole (43) is sealed with a sealing cap (7) and an O-ring (8). A second hole (44) comprises a cable gland (45) which is fixed in the second hole (44) by means of a nut (46). A pipe (47) for wiring is clamped onto the cable gland (45).

The flush-mounted box comprises a mounting bracket (19). The mounting bracket (19) extends flat in a longitudinal direction, whereby the mounting bracket (19) contains two hook elements (19-4) and (19-2), distributed in the longitudinal direction of the mounting bracket (19) and transverse to the plane of the mounting bracket (19). A first hook element (19-4) is positioned at a first end in the longitudinal direction of the mounting bracket (19) and a second hook element (19-2) is movable in the longitudinal direction of the mounting bracket (19). The second hook element (19-2) is loosely fastened to the mounting bracket (19) and can be fixed at several positions along the longitudinal direction of the mounting bracket (19). The second hook element (19-2) is loosely fastened with screws (19-3) and nuts (19-1). The mounting bracket (19) comprises mounting apertures (48) configured for fixing a controller (49) of a light fitting by means of a screw (50) and a nut (51). The controller (49) is adhered to the mounting bracket by means of double-sided adhesive tape as an additional attachment. The double-sided adhesive tape is not visible on the FIG. 1.

Figure 2A:
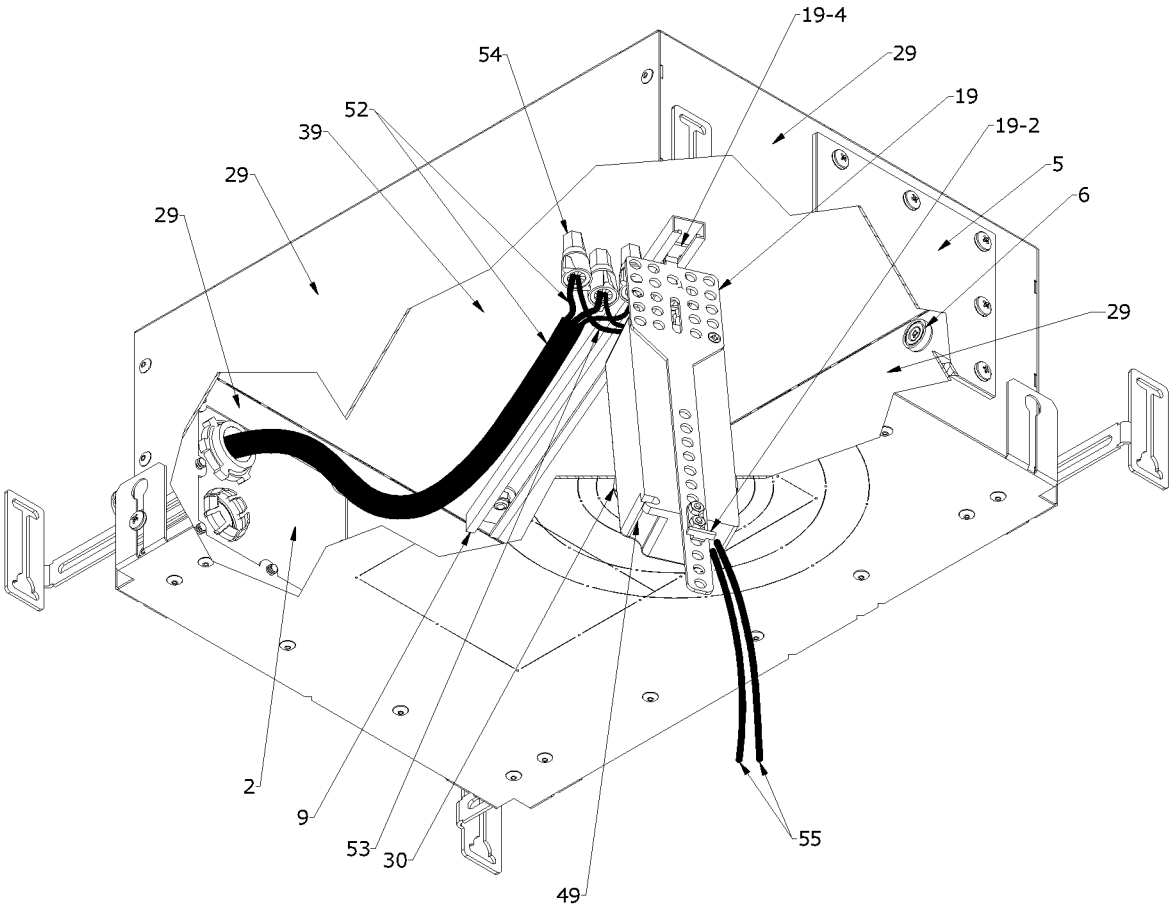
FIG. 2A, FIG. 2B and FIG. 2C show a schematic representation of sliding attachment of a mounting bracket in a rail according to an embodiment of the present invention.
Figure 2B:
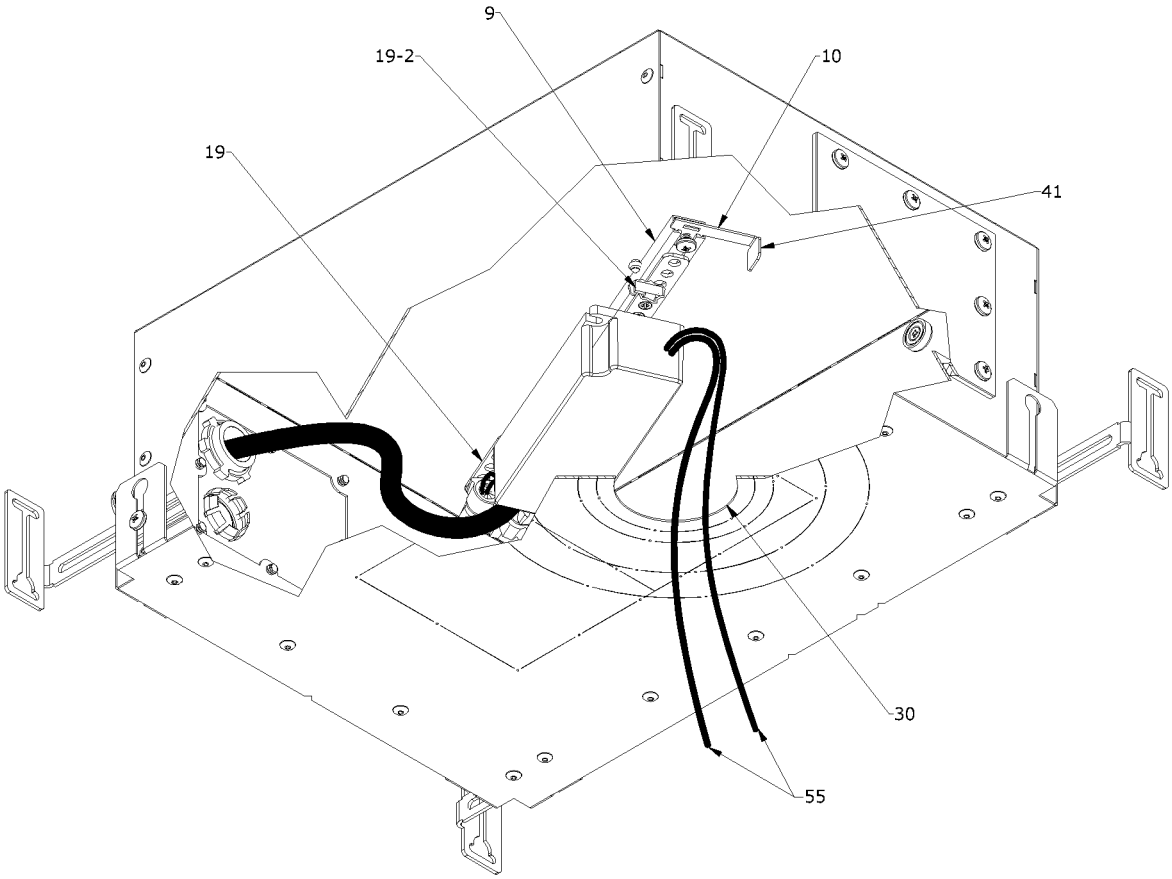
Figure 2C:
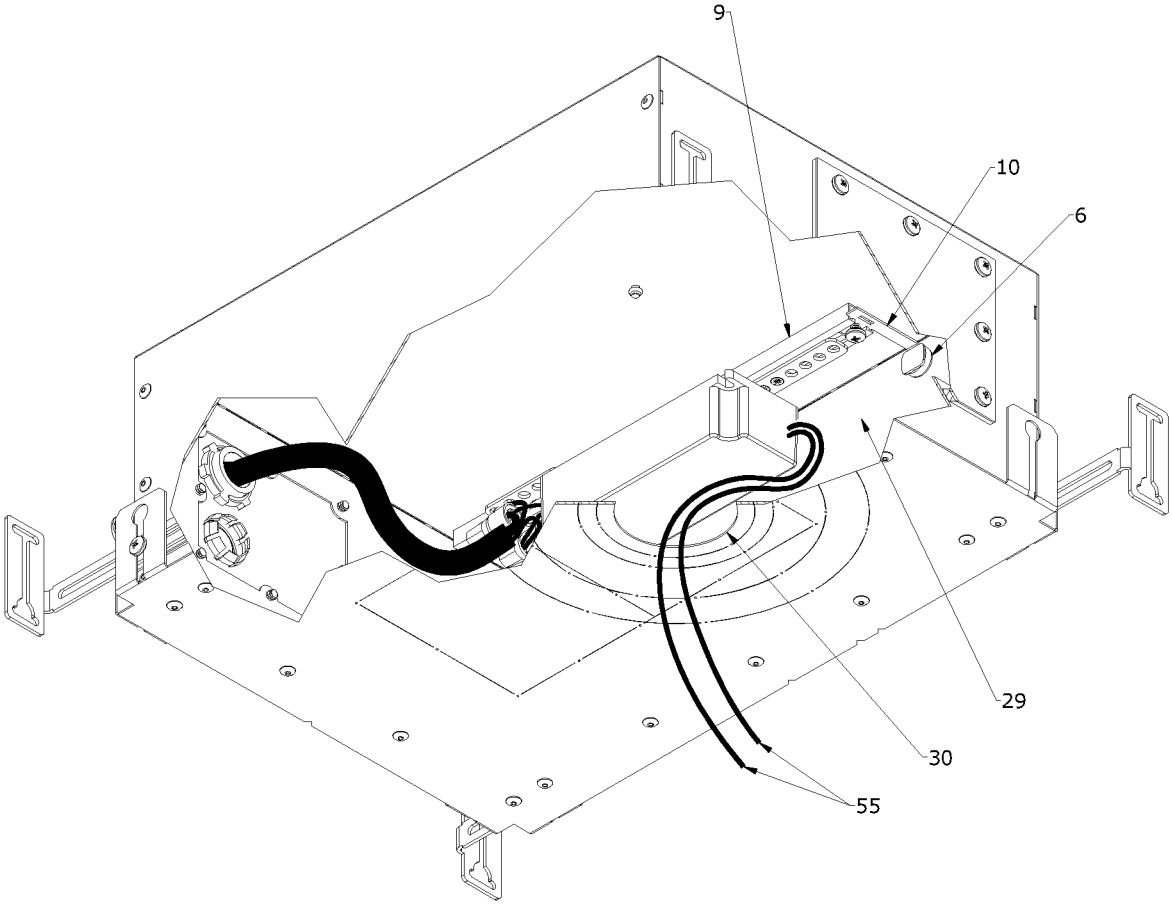

FIG. 2A, FIG. 2B and FIG. 2C show a schematic representation of sliding attachment of a mounting bracket in a rail according to an embodiment of the present invention.

FIG. 2A shows a mounting bracket (19) with a controller (49) attached for a light fitting. Wiring (52) for the mains supply and wiring (53) for the controller (49) are connected together outside the flush-mounting box by means of a connection cap (54) and are inserted through the cutout (30) in the flush-mounting box. The mounting bracket (19) is partially inserted through the cutout (30) into the flush-mounted box and secured with a first hook element (19-4) sliding into the rail (9). Wiring (55) connects the controller (49) with a light fitting. The light fitting is not shown in FIG. 2.

FIG. 2B shows how the mounting bracket (19) is inserted completely through the cutout (30) into the flush-mounted box and how the second hook element (19-2) is fixed in the rail (9) by sliding. At the end of the rail (9) that is positioned above the cutout (30) a stop (10) is placed in the rail (9). Wiring (55) runs through the cutout (30) to a light fitting outside of the flush-mounted box.

FIG. 2C shows how the rail (9) is rotated towards a side wall (29) of the flush-mounted box, with the stop (10) being pulled against the side wall (29) by the magnet (6). Wiring (55) runs through the cut-out (30) to a light fitting outside the flush-mounted box. The light fitting can now be inserted into the cut-out (30).

Figure 3:
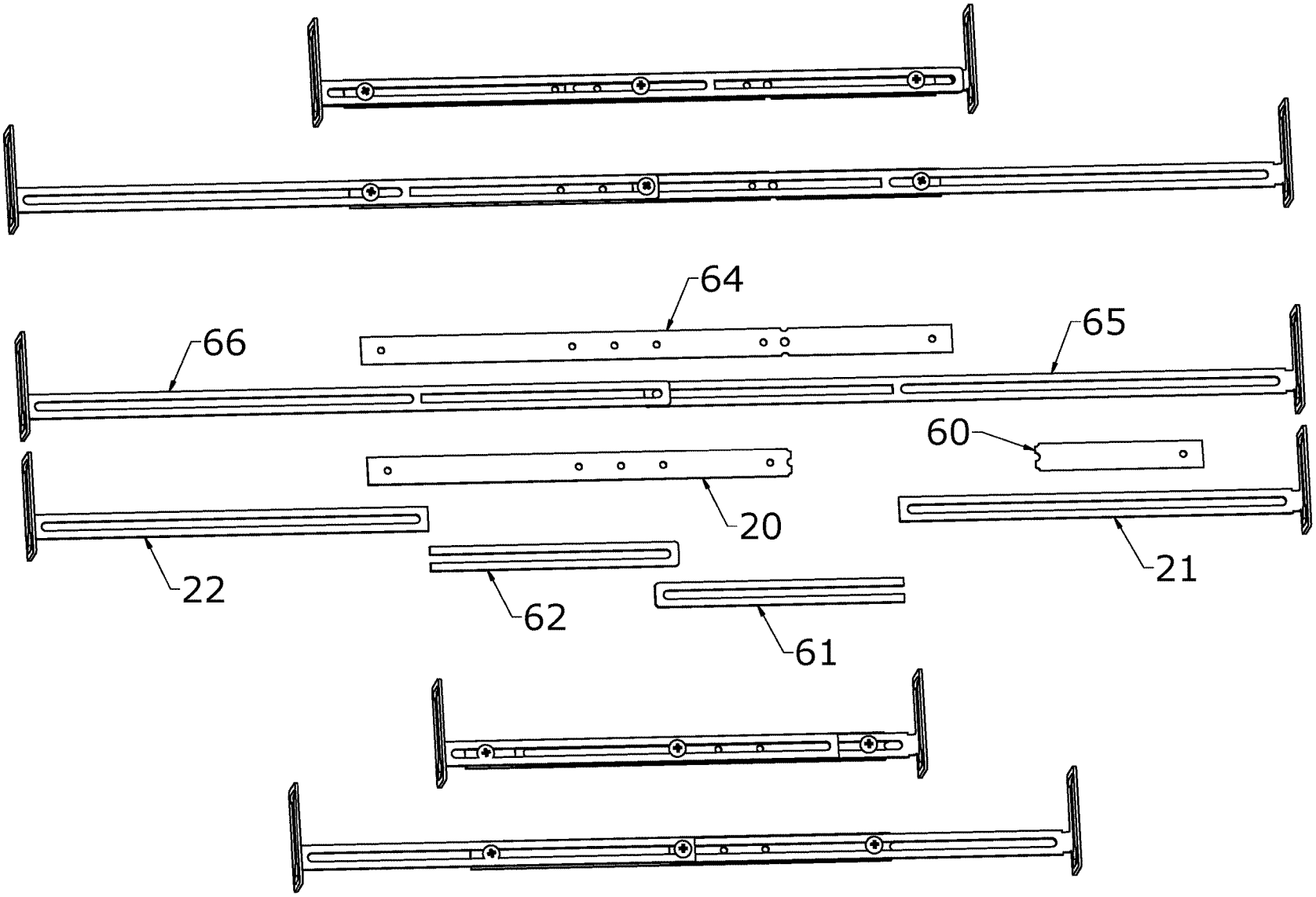
FIG. 3 shows an exploded view of telescopic suspension brackets according to an embodiment of the present invention.

FIG. 3 shows an exploded view of telescopic suspension brackets according to an embodiment of the present invention.

The telescopic suspension brackets, comprise a first slidable part (65), a second slidable part (66) and a mounting plate (64) and are suitable for attachment to a long side of a flush box according to the present invention. The first slidable part (65) and the second slidable part (66) are slidably attached to the mounting plate (64) by means of screws.

By cutting off part (60) of the mounting plate (64), a shortened mounting plate (20) is obtained. By cutting off part (61) of the first slidable part (65), a first shortened slidable part (21) is obtained. By cutting off part (62) of the second slidable part (66), a second shortened slidable part (22) is obtained. By fastening with screws the first shortened sliding part (21) and the second shortened sliding part (22) on the shortened mounting plate (20), shortened telescopic suspension brackets are obtained, which are suitable for fastening on a short side of a flush-mounted box according to the present invention. The shortened telescopic suspension brackets are shown in FIG. 1.

The invention claimed is:

1. A flush-mounted box for installation of a light fitting comprising:

a metal housing that includes:

a plurality of side walls, wherein at least one side wall of the plurality of side walls defines an opening for mounting at least one of a junction box and a cable entry;

a bottom wall mountable to the plurality of side walls and defining at least one cutout configured to receive the light fitting; and a top wall mounted to the plurality of side walls opposite the bottom wall;

a longitudinally-extending rail pivotably attachable to the top wall within the metal housing, wherein one end of the rail is positionable above the at least one cutout and the rail is rotatable in a plane parallel to the bottom wall;

a locking mechanism included on a side wall of the plurality of side walls and operable to detachably fix the rail against the side wall; and a mounting bracket configured for sliding attachment with the rail and slidable along a longitudinal direction of the rail.

2. The flush-mounted box according to claim 1, wherein the locking mechanism comprises a magnet.

3. The flush-mounted box according to claim 2, wherein the locking mechanism further includes a detachable stop removably attached to one end of the rail, and wherein the detachable stop provides a protrusion that provides a ferromagnetic surface that is magnetically attracted to the magnet.

4. The flush-mounted box according to claim 1, wherein the mounting bracket includes a hook element slidably receivable within the rail.

5. The flush-mounted box according to claim 1, wherein the mounting bracket defines a plurality of mounting apertures configured for fixing a controller of the light fitting to the mounting bracket.

6. The flush-mounted box according to claim 1, wherein the bottom wall defines at least one incision that defines a partial perimeter for an opening configured to receive the light fitting.

7. The flush-mounted box according to claim 1, further comprising two telescopic suspension brackets attached to opposing side walls of the plurality of side walls.

8. The flush-mounted box according to claim 7, further comprising at least two lips extending from opposite sides of the bottom wall, wherein each lip defines a keyhole slot that receives a screw for detachable fixing the metal housing to the telescopic suspension brackets.

9. The flush-mounted box according to claim 8, wherein each telescopic suspension bracket includes a mounting plate that defines holes in at least two locations for receiving a bolt or a screw, and wherein the locations of the at least two holes correspond to positions of the at least two lips with corresponding keyhole slots.

10. The flush-mounted box according to claim 1, wherein the metal housing is air tight on the plurality of side walls and the top wall.

11. A kit for forming a flush-mounted box for installation of a light fitting, the kit comprising:

a first flat metal plate for forming a bottom wall;

a second flat metal plate for forming side walls; and a top wall, wherein the first flat metal plate defines at least one cutout configured to receive the light fitting, and wherein the second flat metal plate defines an opening in one of the side walls for fixing at least one of a junction box and a cable entry;

a longitudinally-extending rail pivotably attachable to an underside of the top wall; and a mounting bracket slidably receivable within the rail and slidable along a longitudinal direction of the rail, wherein the second plate comprises a fixing point configured for fixing one end of the rail above the at least one cutout in the bottom wall.

12. The kit according to claim 11, further comprising telescopic suspension brackets attachable to opposing side walls of the side walls.

13. The kit according to claim 11, further comprising at least one of:

self-adhesive and airtight sealing tape;

an airtight composition; and an airtight seal, each being suitable for airtight finishing of gaps between the side walls, the bottom wall and the top wall.

14. A use of a kit for forming a flush-mounted box for installation of a light fitting, the flush mounted box comprising:

a first flat metal plate for forming a bottom wall;

a second flat metal plate for forming side walls; and a top wall, wherein the first flat metal plate defines at least one cutout configured to receive the light fitting, and wherein the second flat metal plate defines an opening in one of the side walls for fixing at least one of a junction box and a cable entry;

a longitudinally-extending rail pivotably attachable to an underside of the top wall; and a mounting bracket slidably receivable within the rail and slidable along a longitudinal direction of the rail, wherein the second plate comprises a fixing point configured for fixing one end of the rail above the at least one cutout in the bottom wall.

* * * * *